US008678130B2

(12) United States Patent
Shiozawa et al.

(10) Patent No.: US 8,678,130 B2
(45) Date of Patent: Mar. 25, 2014

(54) AUDIO APPARATUS

(75) Inventors: Yasuo Shiozawa, Hamamatsu (JP); Hirofumi Onitsuka, Hamamatsu (JP); Akira Miki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/606,669

(22) Filed: Sep. 7, 2012

(65) Prior Publication Data

US 2013/0062139 A1 Mar. 14, 2013

(30) Foreign Application Priority Data

Sep. 9, 2011 (JP) ..... 2011-196855
Aug. 8, 2012 (JP) ..... 2012-176086

(51) Int. Cl.
*G10K 11/00* (2006.01)

(52) U.S. Cl.
USPC ..... 181/175; 181/148; 181/152

(58) Field of Classification Search
USPC ..... 181/148, 152, 175
See application file for complete search history.

(56) References Cited

U.S. PATENT DOCUMENTS

| | | | | | |
|---|---|---|---|---|---|
| 4,616,731 | A * | 10/1986 | Robinson | 181/148 |
| 4,969,196 | A * | 11/1990 | Nakamura | 381/341 |
| 5,373,564 | A * | 12/1994 | Spear et al. | 381/352 |
| 5,714,721 | A * | 2/1998 | Gawronski et al. | 181/156 |
| 6,324,292 | B1 * | 11/2001 | Mitsuhashi et al. | 381/349 |
| 7,461,718 | B2 * | 12/2008 | Dedieu et al. | 181/148 |
| 8,401,216 | B2 * | 3/2013 | Rougas et al. | 381/338 |
| 2004/0222038 | A1 * | 11/2004 | Nakamura | 181/199 |
| 2005/0189164 | A1 * | 9/2005 | Chang | 181/152 |

FOREIGN PATENT DOCUMENTS

| | | | |
|---|---|---|---|
| JP | 2606447 | B2 | 2/1997 |
| JP | 3763682 | B2 | 1/2006 |
| JP | 2008-131199 | A | 6/2008 |

* cited by examiner

*Primary Examiner* — Forrest M Phillips
(74) *Attorney, Agent, or Firm* — Crowell & Moring LLP

(57) ABSTRACT

An audio apparatus includes a housing including a space which is enclosed at least one pair of opposite surfaces, and an open pipe including a first open end and a second open end positioned in the space. The open pipe has a pipe length of integral multiple of a substantially half wavelength of a stationary wave which is generated in the space. The first open end of the open pipe is disposed at a position of a substantial loop of the stationary wave which is generated in the space.

7 Claims, 14 Drawing Sheets

9B
31
32
$LP_{1-1}$
$ND_{1-1}$
$LP_{1-2}$
$LP_{2-1}$
$ND_{2-1}$
$LP_{2-2}$
$ND_{2-2}$
$LP_{2-3}$
$LP_{3-1}$
$ND_{3-1}$
$LP_{3-2}$
$ND_{3-2}$
$LP_{3-3}$
$ND_{3-3}$
$LP_{3-4}$
$LP_{4-1}$
$ND_{4-1}$
$LP_{4-2}$
$ND_{4-2}$
$LP_{4-3}$
$ND_{4-3}$
$LP_{4-4}$
$ND_{4-4}$
$LP_{4-5}$
$LP_{5-1}$
$ND_{5-1}$
$LP_{5-2}$
$ND_{5-2}$
$LP_{5-3}$
$ND_{5-3}$
$LP_{5-4}$
$ND_{5-4}$
$LP_{5-5}$
$ND_{5-5}$
$LP_{5-6}$

AUDIO APPARATUS

BACKGROUND

1. Technical Field

The present invention relates to a technology for suppressing a stationary wave using resonance of a pipe.

2. Background Art

When a sound wave of a specific frequency is irradiated in a space which is enclosed by walls, it is known that stationary waves are generated by reciprocation of the sound wave between the wall surfaces of the space, thereby having a harmful effect on the audio property of an audio appliance. In Japanese Patents Nos. 2606447 and 3763682, and JP-A-2008-131199, technologies for suppressing the stationary wave in a speaker which is one example of the audio appliance are disclosed. The speaker apparatus disclosed in Japanese Patent No. 2606447 includes a speaker unit, a cabinet built equipped with the speaker unit, and a Helmholtz resonator installed in the cabinet. A neck length L and a cavity volume V of the speaker apparatus are designed so that the Helmholtz resonator is resonated at the same frequency as a stationary wave which is generated in the cabinet. With the speaker apparatus, in the case where the stationary wave is generated in the cabinet, the Helmholtz resonator develops a resonance phenomenon, and thus the stationary wave is attenuated by the resonance phenomenon. The speaker apparatus disclosed in Japanese Patent No. 3763682 includes a speaker unit, a cabinet equipped with the speaker unit, and an audio pipe (open pipe) having an open end and a closed end. The audio pipe of the speaker apparatus has a pipe length L of ¼ times as much as the minimum resonance mode of the stationary wave which is generated in the cabinet. The audio pipe is accommodated in the cabinet in a posture in which a position of the open end is close to a position of a loop of sound pressure (node of particle velocity) of the stationary wave in the cabinet. For the speaker apparatus, when the stationary wave (stationary wave having wavelength of four times of the pipe length L) is generated in the cabinet, a resonance wave is generated in the audio pipe. The resonance wave has a node of the sound pressure (loop of particle velocity) at the open end of the audio pipe, and a loop of the sound pressure (node of particle velocity) at the closed end. With the speaker apparatus, a deviation in distribution of the sound pressure in the cabinet is relieved, and thus the stationary wave in the cabinet is attenuated. JP-A-2008-131199 also discloses a technology similar to that disclosed in Japanese Patent No. 3763682.

SUMMARY

The technology of Japanese Patent No. 3763682 and JP-A-2008-131199 matches the position of the loop of the stationary wave in the space with the position of the node of the resonance wave in the audio pipe, and the distribution of the sound pressure in the space is relieved at the position, thereby reducing the stationary wave.

The present invention has been made, and an object of the present invention is to provide a technique for suppressing a stationary wave, which is generated in a space, by use of pipe resonance of an open pipe.

An aspect of the present invention provides an audio apparatus, including: a housing including a space which is enclosed at least one pair of opposite surfaces; and an open pipe including a first open end and a second open end positioned in the space, wherein the open pipe has a pipe length of integral multiple of a substantially half wavelength of a stationary wave which is generated in the space, and the first open end of the open pipe is disposed at a position of a substantial loop of the stationary wave which is generated in the space.

According to the configuration above, when the stationary wave exists in the space, another stationary wave which cannot coexist with the stationary wave is generated in the open pipe, thereby reducing the stationary wave generated in the space.

The audio apparatus may be configured so that the second open end of the open pipe is disposed at a position of a substantial node of the stationary wave which is generated in the space.

The audio apparatus may be configured so that the first and second open ends of the open pipe are respectively disposed at positions which are spaced apart from each other by a length of odd multiple of a substantially quarter wavelength of the stationary wave along an opposite direction of the one pair of opposite surfaces.

The audio apparatus may be configured so that the second open end of the open pipe is disposed at a position of a substantial loop of the stationary wave which is generated in the space.

The audio apparatus may be configured so that at least one of the first and second open ends of the open pipe is wholly or partially covered with an air-permeable sound absorbing material.

Another aspect of the present invention provides an audio apparatus including: a housing including a space which is enclosed at least one pair of opposite surfaces; and an open pipe including a first open end and a second open end positioned in the space, wherein the open pipe has a pipe length of integral multiple of a substantially half wavelength of a stationary wave which is generated in the space.

DETAILED DESCRIPTION OF THE EXEMPLARY EMBODIMENTS

Hereinafter, exemplary embodiments of the invention will be explained with reference to the accompanying drawings.

First Embodiment

Figure 1A:
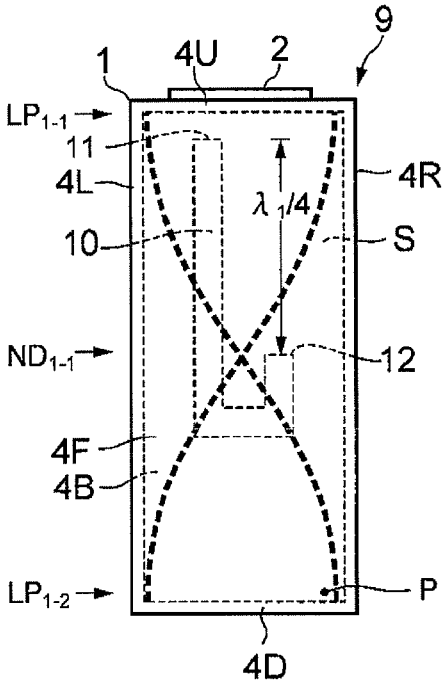
FIG. 1A is a front view of a speaker according to one example of a first embodiment of the present invention.

FIG. 1A is a front view of a speaker 9 which is an audio apparatus according to a first embodiment of the present invention. The speaker 9 includes a cabinet 1, a speaker unit 2 fixed to an outside of the cabinet 1, and an open pipe 10 accommodated in a space S of the cabinet 1. The cabinet 1 is a member serving as a housing of the speaker 9. The cabinet 1 is formed in a hollow rectangular cubic shape enclosed by wall surfaces 4U and 4D opposite to each other in upward and downward directions, wall surfaces 4F and 4B opposite to each other in back and forth directions, and wall surfaces 4L and 4R opposite to each other in right and left directions. A height H (distance between the wall surfaces 4U and 4D; for example, H=1050 mm) in the space S of the cabinet 1 is set to be sufficiently larger than a depth L (distance between the wall surfaces 4F and 4B; for example, L=200 mm) or a width W (distance between the wall surfaces 4L and 4R; for example, W=300 mm).

The speaker unit 2 is an apparatus serving as a sound generating source in the speaker 9. The speaker unit 2 is built in a substantially center portion of the wall surface 4U of the cabinet 1, with a sound-emission surface facing an outside. The speaker unit 2 is input with an electric signal from an audio apparatus (not illustrated). The speaker unit 2 irradiates the electric signal as a sound wave. In the case where a sound wave of the same frequency as its natural frequency is transferred to the space S from the speaker unit 2, the sound wave reciprocates between the wall surfaces 4U and 4D of the space S, and thus plural sound waves reciprocating between the wall surfaces 4U and 4D are combined with each other to generate stationary waves $SW_k$ (k=1, 2, . . . ) having a wavelength $\lambda_k$ (k=1, 2, . . . ) which is 2/k (k=1, 2, . . . ) times as much as a distance between the wall surfaces 4U and 4D.

The open pipe 10 is a member for reducing the stationary waves $SW_k$. The open pipe 10 has a pipe length of a substantially half wavelength of the lowest order one (first-order stationary wave $SW_1$ in the example of FIG. 1A) of the stationary waves $SW_k$ to be suppressed. The term "substantially" or its similar term in the meaning of the substantially half wavelength of the lowest order one of the stationary waves $SW_k$ to be suppressed indicates a variation within ±20% of the half wavelength, and the same applies to the following embodiments. The open pipe 10 is formed in a J-shape which is bent at a right angle at two points in the halfway leading from one open end 11 to the other open end 12. The open pipe 10 is accommodated in the space S in a posture which satisfies two following conditions 'a1' and 'b1', where condition 'a1' is one condition in which one open end 11 and the other open end 12 are respectively disposed at positions of a substantial loop LP and a substantial node ND of a sound pressure of the lowest order one of the stationary waves $SW_k$ to be suppressed in the space S; and condition 'b1' is another condition in which one open end 11 and the other open end 12 are respectively disposed at each position spaced apart by about quarter wavelength of the stationary waves $SW_k$ in an opposite direction of two opposite surfaces of the wall surfaces 4U and 4D in the space S. The term "substantial" or its similar term in the meaning of the position of the substantial loop LP indicates a variation within ±10% from the position of the loop of the wavelength of the stationary wave. Further, the term "substantial" or its similar term in the meaning of the position of the substantial node ND indicates a variation within ±10% from the position of the node of the wavelength of the stationary wave. The same applies to the following embodiments with regard to the range of the variation.

Figure 1B:
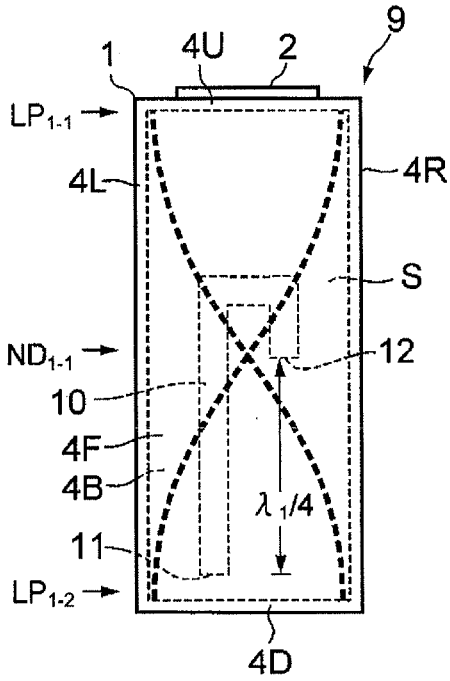
FIG. 1B is a front view of a speaker according to another example of the first embodiment of the present invention.

The configuration of the speaker 9 according to the first embodiment is described in detailed hereinbefore. In the example of FIG. 1A, the open end 11 is disposed at the position of the loop $LP_{1-1}$, which is on the side of the wall surface 4U, of two loops $LP_{1-1}$ and $LP_{1-2}$ of the first-order stationary wave $SW_1$, and the open end 12 is disposed at the position of the node $ND_{1-1}$ between the two loops $LP_{1-1}$ and $LP_{1-2}$. As illustrated in the example of FIG. 1B, however, the open end 11 may be disposed at the position of the loop $LP_{1-2}$ on the side of wall surface 4D, and the open end 12 may be disposed at the position of the node $ND_{1-1}$. The open pipe 10 is accommodated in the space S in the posture illustrated in FIGS. 1A and 1B, thereby reducing first-order or more stationary waves $SW_k$ in the space S. As well known, in the case where a sound generating source is positioned at the position of the node $ND_{1-1}$ of the first-order stationary wave $SW_1$ on the wall surfaces 4U, 4D, 4L, 4F and 4B forming the cabinet 1 of the speaker 9, the odd-order first-order stationary waves $SW_1$, $SW_3$, $SW_5$, . . . in the space S are suppressed by vibration of the sound generating source (specifically, see JP-A-2008-131199). Accordingly, as the speaker 9A illustrated in the example of FIG. 2, in the case in which the speaker unit 2 is disposed at the position of the node $ND_{1-1}$ of the first-order stationary wave $SW_1$, an open pipe 20 having a pipe length of approximately half wavelength of the second stationary wave $SW_2$ may be accommodated in the space S in the posture which satisfies the above-described conditions 'a1' and 'b1'. When the open pipe 20 is accommodated in the space S in the above posture, it is also possible to reduce the first-order or more stationary wave $SW_k$ in the space S.

Figure 3:
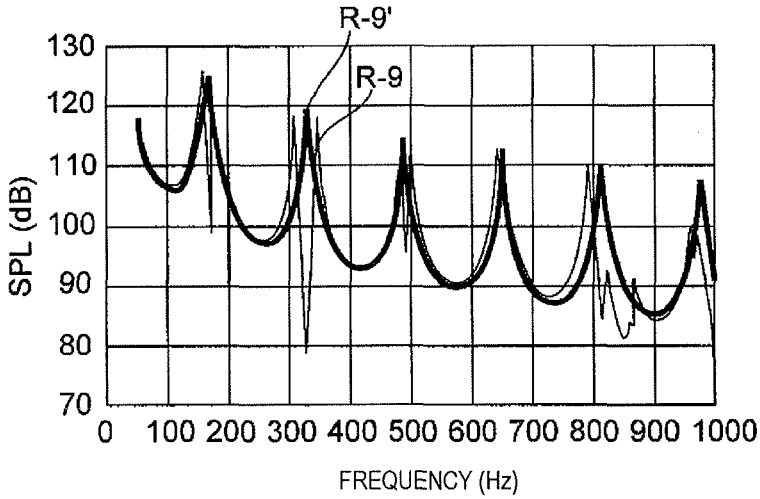
FIG. 3 is a graph illustrating a frequency response which is a first verification result of a speaker effect.
Figures 4A, 4B, 4C, 4D, 4E:
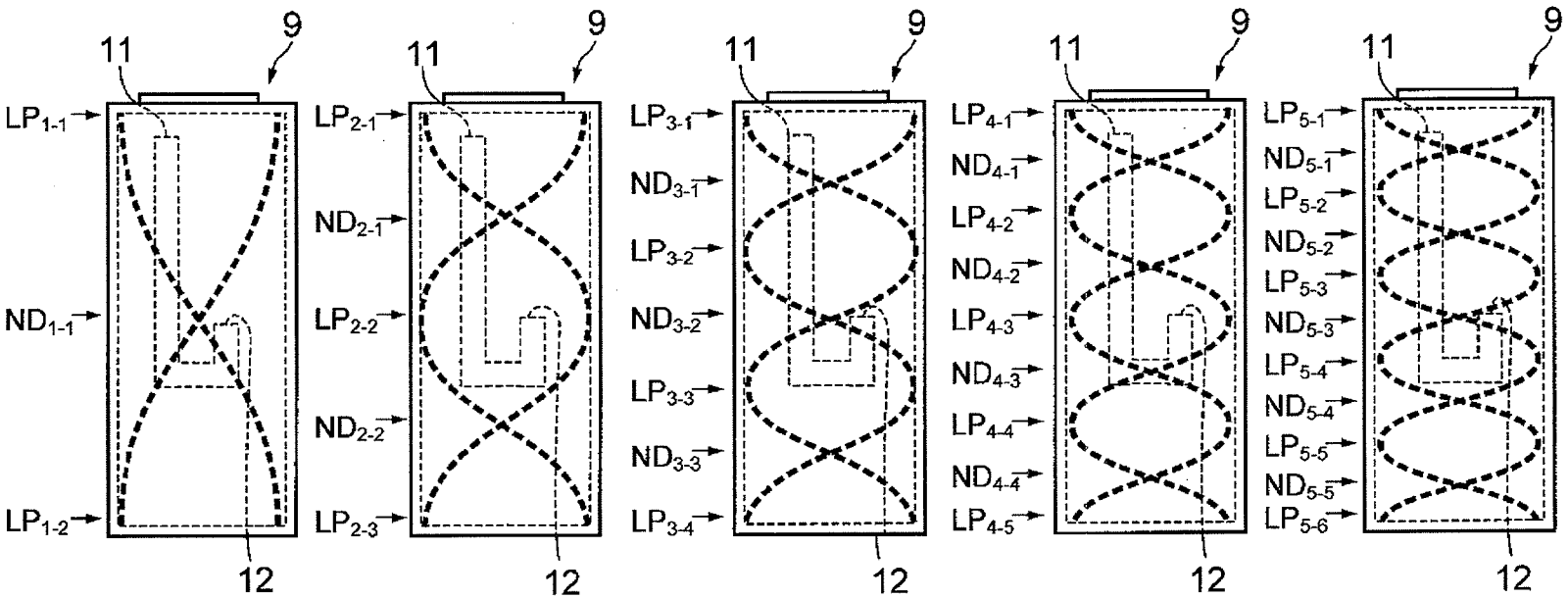
FIGS. 4A to 4E are diagrams, each illustrating a position relationship between a stationary wave and an open end of an open pipe in the speaker.

The inventors carried out three verifications in order to confirm the effect of this embodiment. First, a first verification will be explained. For the speaker 9 which is the example illustrated in FIG. 1A, by inputting a test sound signal ST (e.g., white noise) to the speaker unit 2 and measuring the sound wave irradiated from the speaker unit 2 at a measuring point P in the space S (more specifically, a measuring point P in the inner vicinity of the position in which the wall surfaces 4D, 4B and 4R are intersected) (see FIG. 1A), the inventors calculated a frequency response R-9 which is a spectrum difference between the input signal ST and a measured signal SM by means of simulation. Similarly, for a speaker 9' in which the open pipe 10 is removed from the speaker 9, by inputting a test sound signal ST to the speaker unit 2 and measuring the sound wave irradiated from the speaker unit 2 at the measuring point P, the inventors calculated a frequency response R-9' which is a spectrum difference between the input signal ST and a measured signal SM by means of simulation. FIG. 3 illustrates the frequency responses R-9 and R-9' at the same frequency axis.

Referring to FIG. 3, a peak appears in the proximity of 160 Hz, 320 Hz, 480 Hz, 650 Hz, 820 Hz, and 960 Hz in any frequency responses R-9 and R-9'. For the frequency response R-9, amplitude of the peak in the proximity of 650 Hz is substantially equal to that in the frequency response R-9', but amplitude of the peaks in the proximity of 160 Hz, 320 Hz, 480 Hz, 820 Hz and 970 Hz is smaller than that in the frequency response R-9'. Also, for the frequency response R-9, the peaks in the proximity of 160 Hz, 320 Hz, 480 Hz, 820 Hz and 970 Hz are split. It is confirmed from this fact that the first-order stationary wave $SW_1$ (160 Hz), the second-order stationary wave $SW_2$ (320 Hz), the third-order stationary wave $SW_3$ (480 Hz), the fifth-order stationary wave $SW_5$ (820 Hz) and the sixth-order stationary wave $SW_6$ (970 Hz) are suppressed in the space S by the speaker 9. The invertors made an assumption about that suppression of the stationary waves $SW_1$, $SW_2$, $SW_3$, $SW_5$ and $SW_6$ by the speaker 9 which is the example of FIG. 1A is caused by the following reason, except for the fourth-order stationary wave $SW_4$, on the basis of the verified result of the first verification. As illustrated in FIGS. 4A to 4E, the open end 11 of the open pipe 10 in the space S is disposed at the position of the loop $LP_{1-1}$ of the stationary wave $SW_1$ in the speaker 9. The position of the loop $LP_{1-1}$ of the stationary wave $SW_1$ corresponds to the loops $LP_{2-1}$, $LP_{3-1}$, $LP_{4-1}$, $LP_{5-1}$, . . . of the second-order and subsequent stationary waves $SW_2$, $SW_3$, $SW_4$, $SW_5$, . . . . Also, the open end 12 of the open pipe 10 in the space S is disposed at the position of the node $ND_{1-1}$ of the stationary wave $SW_1$. The position of the node $ND_{1-1}$ of the stationary wave $SW_1$ corresponds to the loops $LP_{2-2}$ and $LP_{4-3}$ of the second and subsequent even-order stationary waves $SW_2$ and $SW_4$ and the nodes $ND_{3-2}$ and $ND_{5-3}$ of the third-order and subsequent odd-order stationary waves $SW_3$ and $SW_5$. Accordingly, in the case where the stationary wave $SW_k$ (k=1, 2, . . . ) is generated in the space S, a medium (air) in the vicinity of the open end 11 of the open pipe 10 is vibrated by variation in sound pressure at the position of the loop LP of the odd- and even-order stationary wave $SW_k$, and a medium (air) in the vicinity of the open end 12 is vibrated by variation in sound pressure at the position of the loop LP of the even-order stationary wave $SW_k$.

Figure 5A:
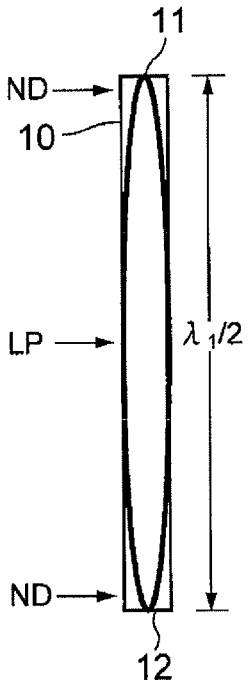
FIGS. 5A to 5C are diagrams, each illustrating a waveform of a resonance wave in the open pipe of the speaker.

In view of the relationship between the first-order stationary wave $SW_1$ in the space S and the behavior of the medium (air) in the open pipe 10, the medium (air) in the vicinity of the open end 11 of the open pipe 10 is vibrated by variation in sound pressure of the loop $LP_{1-1}$ of the stationary wave $SW_1$, and a traveling wave $TW_1$ facing from the open end 11 to the open end 12 is generated. The traveling wave $TW_1$ is transferred into the open pipe 10, and then reaches the open end 12. Since the position in which the open end 12 of the open pip 10 is disposed in the space S is the position of the node $ND_{1-1}$ of the stationary wave $SW_1$, the medium (air) in the vicinity of the open end 12 is hardly vibrated even though the traveling wave $TW_1$ reaches the open end 12. For this reason, if the traveling wave $TW_1$ reaches the open end 12, a reflected wave $RW_1$ is generated in the open end 12. If the reflected wave $RW_1$ and the traveling wave $TW_1$ are composed in the open pipe 10, a resonance wave $XW_1$ having the same wavelength $\lambda_1$ as that of the stationary wave $SW_1$ is generated. The resonance wave $XW_1$ is generated by composing the traveling wave $TW_1$ and the reflected wave $RW_1$ reflected by the traveling wave $TW_1$ from the open end 12, as illustrated in FIG. 5A, so that the resonance wave $XW_1$ at the sides the open end 11 and the open end 12 becomes the node ND, respectively. For this reason, distribution in sound pressure of the stationary wave $SW_1$ at the position of the open end 11 is alleviated. The inventors made an assumption about that alleviation of the stationary wave $SW_1$ is caused by the above reason. Also, the existence of the node ND at the position of the open end 12 is in common with all odd-order stationary wave $SW_k$. Therefore, the inventors made an assumption about that the odd-order stationary waves $SW_3$, $SW_5$, $SW_7$, . . . of three-order or subsequent are alleviated by the same reason.

Figure 5B:
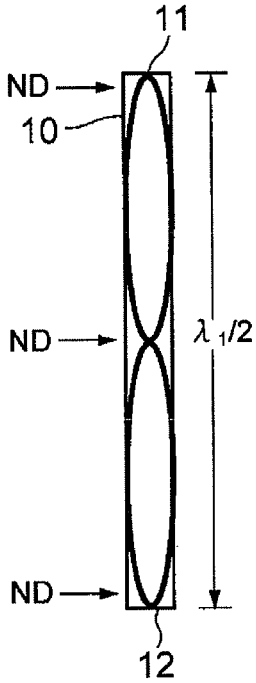

Next, in view of the relationship between the second-order stationary wave $SW_2$ in the space S and the behavior of the medium (air) in the open pipe 10, the medium (air) in the vicinity of the open ends 11 and 12 of the open pipe 10 is vibrated by variation in sound pressure of the loops $LP_{2-1}$ and $LP_{2-2}$ of the stationary wave $SW_2$, and traveling waves $TW_2$ and $TW_2$" traveling in an opposite direction and having a n phase difference therebetween is generated. The reason why the traveling waves $TW_2$ and $TW_2$" have the n phase difference is that the sound pressure of two adjacent loops LP in the stationary wave $SW_k$ are varied while having the $\pi$ phase difference. If the traveling waves $TW_2$ and $TW_2$" are composed in the open pipe 10, a resonance wave $XW_2$ having the same wavelength $\lambda_2$ as that of the stationary wave $SW_2$ is generated. The resonance wave $XW_2$ is generated by composing the traveling waves $TW_2$ and $TW_2$" having the n phase difference, as illustrated in FIG. 5B, so that the resonance wave $XW_2$ becomes the node ND at a middle of the open ends 11 and 12. Also, since a pipe length (pipe length of a half wavelength of the first-order stationary wave $SW_1$) of the open pipe 10 is equal to a wavelength $\lambda_2$ ($\lambda_2=\lambda_1/2$) of the stationary wave $SW_2$, if the middle of the open ends 11 and 12 becomes the node ND, the sides of the open ends 11 and 12 also become the node ND. For this reason, distribution in sound pressure of the stationary wave $SW_2$ at the positions of the open ends 11 and 12 is alleviated. The inventors made an assumption about that the alleviation of the stationary wave $SW_2$ is caused by the above reason. Also, the variation in the sound pressure at the position of the open end 11 and the sound pressure of the open end 12 while having the $\pi$ phase difference is in common with the sixth-order stationary wave $SW_6$ and the tenth-order stationary wave $SW_{10}$. Therefore, the inventors made an assumption about that the sixth-order stationary wave $SW_6$ or the tenth-order stationary wave $SW_{10}$ is alleviated by the same reason.

Figure 5C:
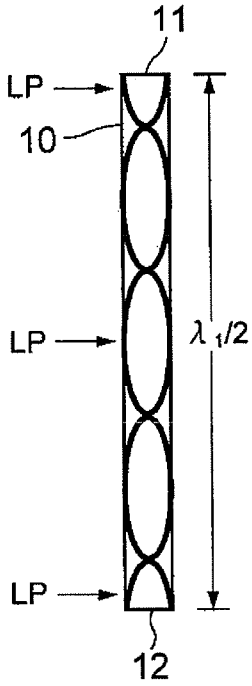

Next, in view of the relationship between the fourth-order stationary wave $SW_4$ in the space S and the behavior of the medium (air) in the open pipe 10, the medium (air) in the vicinity of the open ends 11 and 12 of the open pipe 10 is vibrated by variation in sound pressure of the loops $LP_{4-1}$ and $LP_{4-3}$ of the stationary wave $SW_4$, and traveling waves $TW_4$ and $TW_4$" traveling in an opposite direction and having the same phase is generated. The reason why the traveling waves $TW_4$ and $TW_4$" have the same phase is that the sound pressure of two loops LP, which are spaced apart from each other while one loop LP is interposed therebetween, in the stationary wave $SW_k$ are varied at the same phase. If the traveling waves $TW_4$ and $TW_4$" are composed in the open pipe 10, a resonance wave $XW_4$ having the same wavelength $\lambda_4$ as that of the stationary wave $SW_4$ is generated. The resonance wave $XW_4$ is generated by composing the traveling waves $TW_4$ and $TW_4$" having the same phase, as illustrated in FIG. 5C, so that the resonance wave $XW_4$ becomes the loop LP at the middle of the open ends 11 and 12. Also, since the pipe length (pipe length of a half wavelength of the first-order stationary wave $SW_1$) of the open pipe 10 is two times of a wavelength $\lambda_4$ ($\lambda_4=\lambda_1/4$) of the stationary wave $SW_4$, if the middle of the open ends 11 and 12 becomes the loop LP, the sides of the open ends 11 and 12 also become the loop LP. For this reason, distribution in sound pressure of the stationary wave $SW_4$ at the positions of the open ends 11 and 12 is not alleviated. The inventors made an assumption about that the stationary wave $SW_1$ which is not alleviated as much as the fourth-order stationary wave $SW_4$ is caused by the above reason. Also, the variation in the sound pressure at the position of the open end 11 and the sound pressure of the open end 12 while having the same phase is in common with the eighth-order stationary wave $SW_8$. Therefore, the inventors made an assumption about that the eighth-order stationary wave $SW_8$ is not alleviated by the same reason as the fourth-order stationary wave $SW_4$.

Figure 2:
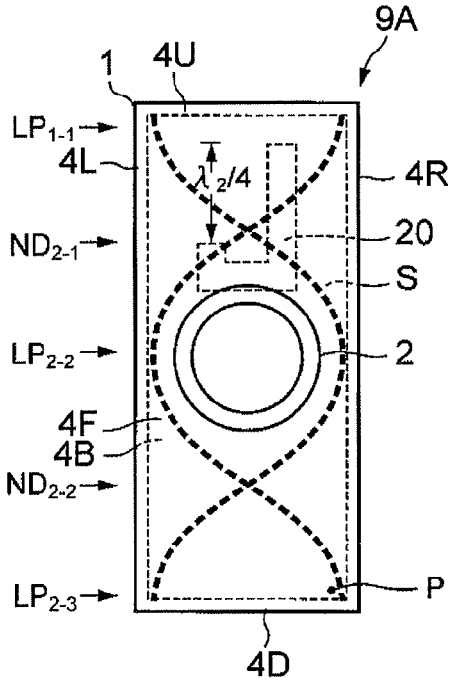
FIG. 2 is a front view of a speaker according to another example of the first embodiment of the present invention.
Figure 6:
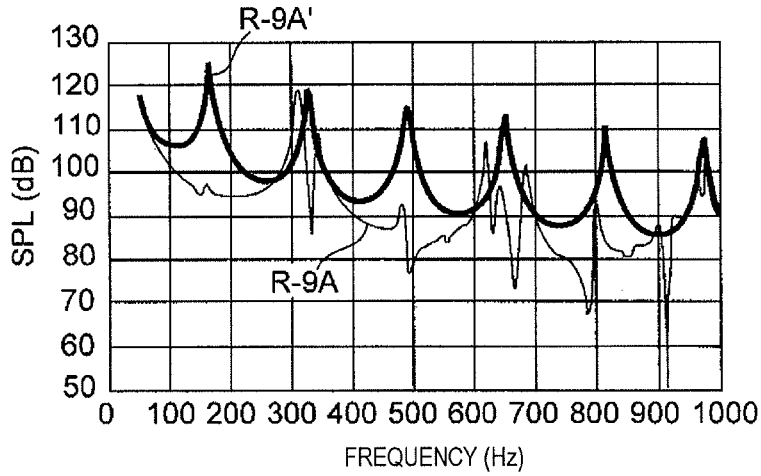
FIG. 6 is a graph illustrating a frequency response which is a verification result of a second verification of a speaker effect.

Next, a second verification will be explained. For the speaker 9A is illustrated in FIG. 2, by inputting a test sound signal ST to the speaker unit 2 and measuring the sound wave irradiated from the speaker unit 2 at a measuring point P in the space S (more specifically, measuring point P in the inner vicinity of the position in which the wall surfaces 4D, 4B and 4R are intersected) (see FIG. 2), the inventors calculated a frequency response R-9A which is a spectrum difference between the input signal ST and a measured signal SM by means of simulation. Similarly, for a speaker 9A' in which the open pipe 10 is removed from the speaker, by inputting a test sound signal ST to the speaker unit 2 and measuring the sound wave irradiated from the speaker unit 2 at the measuring point P, the inventors calculated a frequency response R-9A' which is a spectrum difference between the input signal ST and a measured signal SM by means of simulation. FIG. 6 illustrates the frequency responses R-9A and R-9A' at the same frequency axis. Referring to FIG. 6, a peak appears in the proximity of 160 Hz, 320 Hz, 480 Hz, 650 Hz, 820 Hz, and 970 Hz in any frequency responses R-9A and R-9A'. For the frequency response R-9A, amplitude of the peak in the proximity of 160 Hz, 320 Hz, 480 Hz, 650 Hz, 820 Hz, and 970 Hz is smaller than that in the frequency response R-9A'. The peaks in the proximity of 320 Hz, 480 Hz, 650 Hz, 820 Hz and 970 Hz are split. It is confirmed from this fact that the first-order to six-order stationary waves $SW_1$ to $SW_6$ are suppressed in the space S by the speaker 9A.

Figure 7:
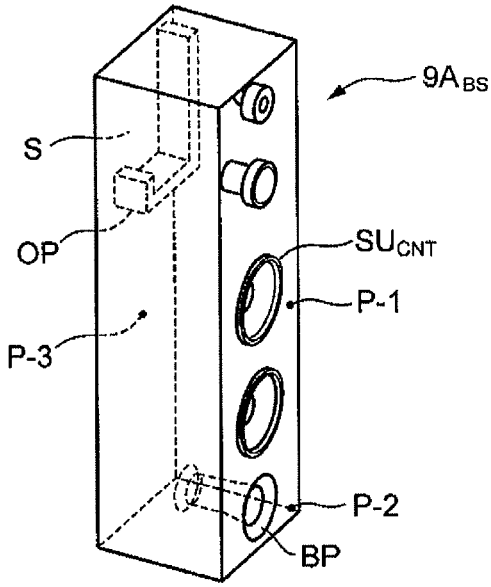
FIG. 7 is a perspective view of a bass reflex speaker manufactured by a verification result for a third verification of a speaker effect.

Next, a third verification will be explained. In the third verification, the inventors actually measured the frequency response from the open pipe which is accommodated in a bass reflex speaker and has a pipe length of a substantially half wavelength of the second-order stationary wave $SW_2$. More specifically, as illustrated in FIG. 7, a speaker $9A_{BS}$ is configured in which an open pipe OP having a pipe length of a substantially half wavelength of the second-order stationary wave $SW_2$ is accommodated in the space S (space S having dimensions of a vertical width H (H=1050 mm), a horizontal width W (W=200 mm), and a depth L (L=300 mm)) in the bass reflex speaker in the posture satisfying the above conditions 'a1' and 'b1'. In addition, a speaker $9A_{BS}$' is configured by removing the open pipe OP from the speaker $9A_{BS}$.

In addition, a position near a front surface of a center speaker unit $SU_{CNT}$ in the speakers $9A_{BS}$ and $9A_{BS}$' is set as a first measurement point P-1, a position near a front surface of a bass reflex port BP in the speakers $9A_{BS}$ and $9A_{BS}$' is set as a second measurement point P-2, and an inner position of a substantial center of a wall surface opposite to the side of the speaker unit $SU_{CNT}$ is set to a third measurement point P-3. A sound signal is input to the speaker unit $SU_{CNT}$ of the speakers $9A_{BS}$ and $9A_{BS}$', and a sound wave irradiated from the speaker unit $SU_{CNT}$ is measured at the measurement points P-1, P-2 and P-3 in accordance with the sound signal.

Figure 8:
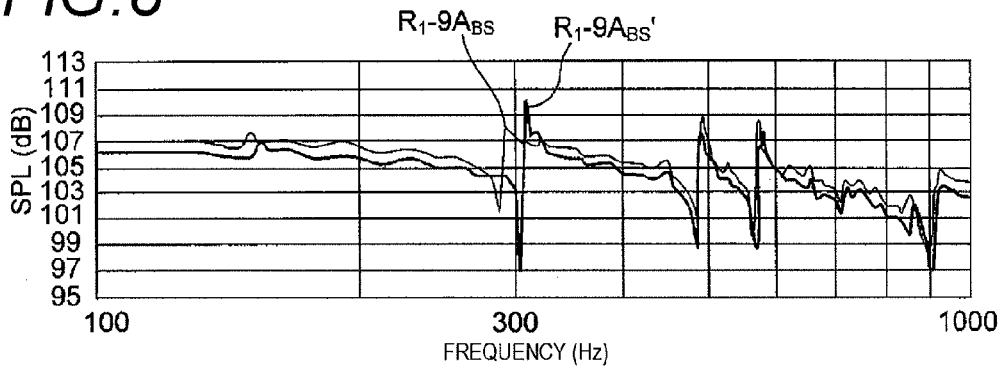
FIG. 8 is a graph illustrating a frequency response which is a verification result of the third verification of the speaker effect.
Figure 9:
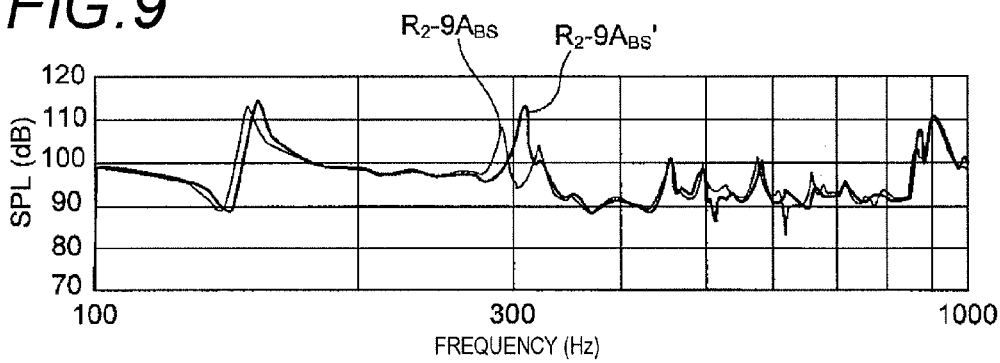
FIG. 9 is a graph illustrating a frequency response which is a verification result of the third verification of the speaker effect.
Figure 10:
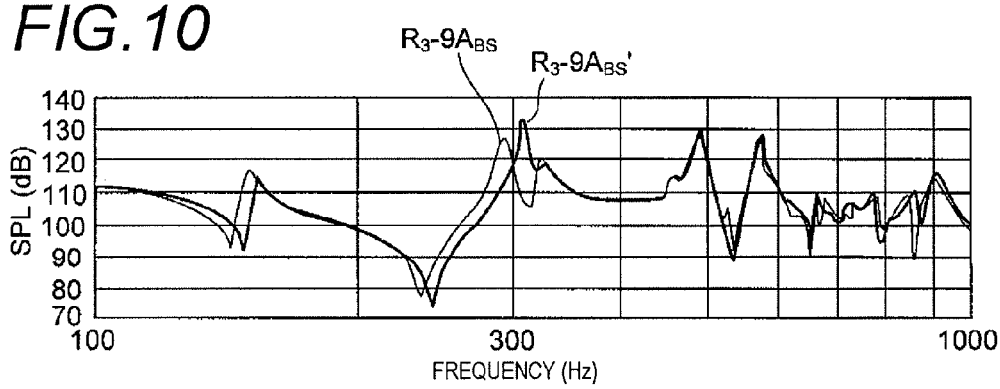
FIG. 10 is a graph illustrating a frequency response which is a verification result of the third verification of the speaker effect.

For the speaker $9A_{BS}$, frequency responses $R_1$-$9A_{BS}$, $R_2$-$9A_{BS}$ and $R_3$-$9A_{BS}$ which are spectrum differences of the input signal ST of the speaker unit $SU_{CNT}$ and the measured signal SM at the measurement points P-1, P-2 and P-3 are calculated. Similar to the speaker $9A_{BS}$', frequency responses $R_1$-$9A_{BS}$', $R_2$-$9A_{BS}$' and $R_3$-$9A_{BS}$' which are spectrum differences of the input signal ST of the speaker unit $SU_{CNT}$ and the measured signal SM at the measurement points P-1, P-2 and P-3 are calculated. FIG. 8 illustrates the frequency responses $R_1$-$9A_{BS}$ and R-$9A_{BS}$' at the same frequency axis. FIG. 9 illustrates the frequency responses $R_2$-$9A_{BS}$ and $R_2$-$9A_{BS}$' at the same frequency axis. FIG. 10 illustrates the frequency responses $R_3$-$9A_{BS}$ and $R_3$-$9A_{BS}$' at the same frequency axis.

In FIGS. 8, 9 and 10, peaks are generated in the proximity of 300 Hz in the frequency responses $R_1$-$9A_{BS}$', $R_2$-$9A_{BS}$' and $R_3$-$9A_{BS}$'. They indicate that the second-stationary wave $SW_2$ is not effectively suppressed by the resonance of the bass reflex port BF in the bass reflex speaker. By contrast, for the frequency responses $R_1$-$9A_{BS}$, $R_2$-$9A_{BS}$ and $R_3$-$9A_{BS}$, the peak is split into two in the proximity of 300 Hz, and each amplitude is smaller than that of the frequency responses $R_1$-$9A_{BS}$', $R_2$-$9A_{BS}$' and $R_3$-$9A_{BS}$'. It is confirmed from this fact that the second-order stationary wave $SW_2$ which is an object to be suppressed can be suppressed by the speaker $9A_{BS}$.

From the verification result (FIG. 6) of the above-described second verification, it is verified that the first-order to sixth-order stationary waves $SW_1$ to $SW_6$ can be suppressed, but from the verification result (FIGS. 8, 9 and 10) of the third verification, it is not verified that the high-order stationary waves such as the third-order to sixth-order stationary waves $SW_3$ to $SW_6$ can be suppressed. The inventors made an assumption about the reason as follows. If the space in the speaker $9A_{BS}$ is completely closed, the wavelengths $\lambda_2$, $\lambda_3$, $\lambda_4$, . . . of the second-order and subsequent stationary waves $SW_2$, $SW_3$, $SW_4$, . . . coincide with an integral multiplication of the wavelength $\lambda_1$ of the first-order stationary wave $SW_1$. However, in the case where there are additional elements such as the bass reflex port BF of the speaker $9A_{BS}$, $\lambda_2$, $\lambda_3$, $\lambda_4$, . . . of the second-order and subsequent stationary waves $SW_2$, $SW_3$, $SW_4$ may not coincide with the integral multiplication of the first-order stationary wave $SW_1$. By contrast, the wavelength of the second-order and subsequent resonance waves $XW_2$, $XW_3$, $XW_4$, . . . in the open pipe OP of the speaker $9A_{BS}$ always coincide with an integral multiplication of the first resonance wave $XW_1$. For this reason, in the speaker $9A_{BS}$, there is a case where a frequency does not coincide with each other between the high-order stationary wave SW and the resonance wave XW. The inventors made an assumption about that the third-order to sixth-order stationary waves $SW_3$ to $SW_6$ are not suppressed in the speaker $9A_{BS}$.

Second Embodiment

Figure 11A:
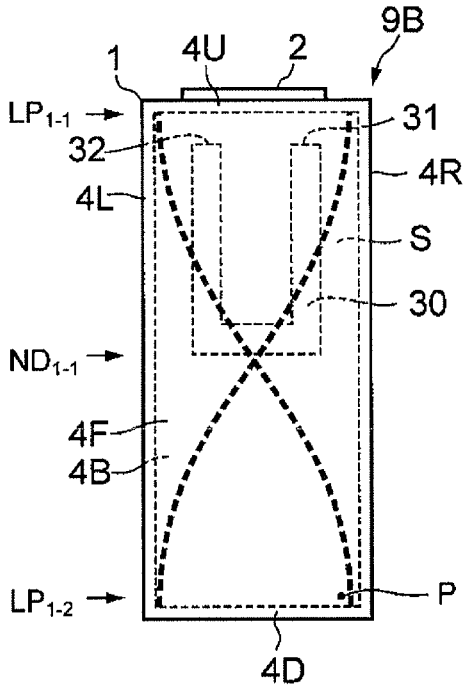
FIG. 11A is a front view of a speaker according to one example of a second embodiment of the present invention.

FIG. 11A is a front view of a speaker 9B which is an audio apparatus according to a second embodiment of the present invention. The open pipe 10 in the space S (the hollow space S enclosed by three pairs of opposite surfaces of the wall surfaces 4U and 4D, the wall surfaces 4F and 4B, and the wall surfaces 4L and 4R) of the cabinet 1 in the speaker 9 according to the first embodiment is replaced by an open pipe 30 in the speaker 9B according to the second embodiment. The open pipe 30 has a pipe length of a substantially half wavelength of the first-order stationary wave $SW_1$. The open pipe 30 is formed in a U-shape. The open pipe 30 is accommodated in the space S in a posture which satisfies following condition 'c1' in which both open ends 31 and 32 of the open pipe 30 are disposed at positions of the same loop LP as that the lowest order one of the stationary waves $SW_k$ to be suppressed in the space S or near the positions.

Figure 11B:
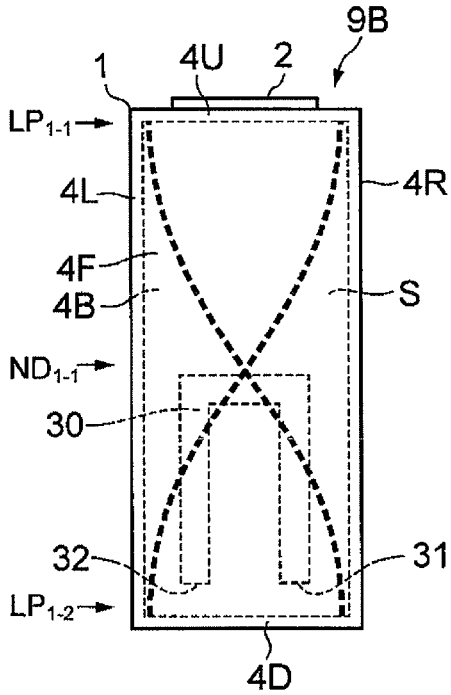
FIG. 11B is a front view of a speaker according to another example of the second embodiment of the present invention.

The configuration of the speaker 9B according to the second embodiment is described in detailed hereinbefore. In the example of FIG. 11A, the open ends 31 and 32 are disposed at the positions of the loops $LP_{1-1}$, which is on the side of the wall surface 4U, of two loops $LP_{1-1}$ and $LP_{1-2}$ of the first-order stationary wave $SW_1$. As illustrated in the example of FIG. 11B, however, the open ends 31 and 32 may be disposed at the position of the loop $LP_{1-2}$ on the side of wall surface 4D. The open pipe 30 can be accommodated in the space S in the posture illustrated in FIG. 11A or 11B, thereby reducing the first-order or more stationary wave $SW_k$ in the space S.

Figure 12:
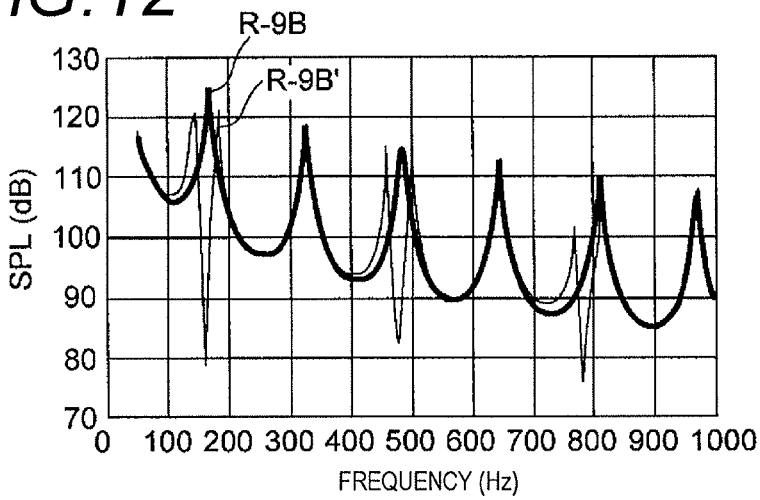
FIG. 12 is a graph illustrating a frequency response which is a verification result of a speaker effect.
Figures 13A, 13B, 13C, 13D, 13E:
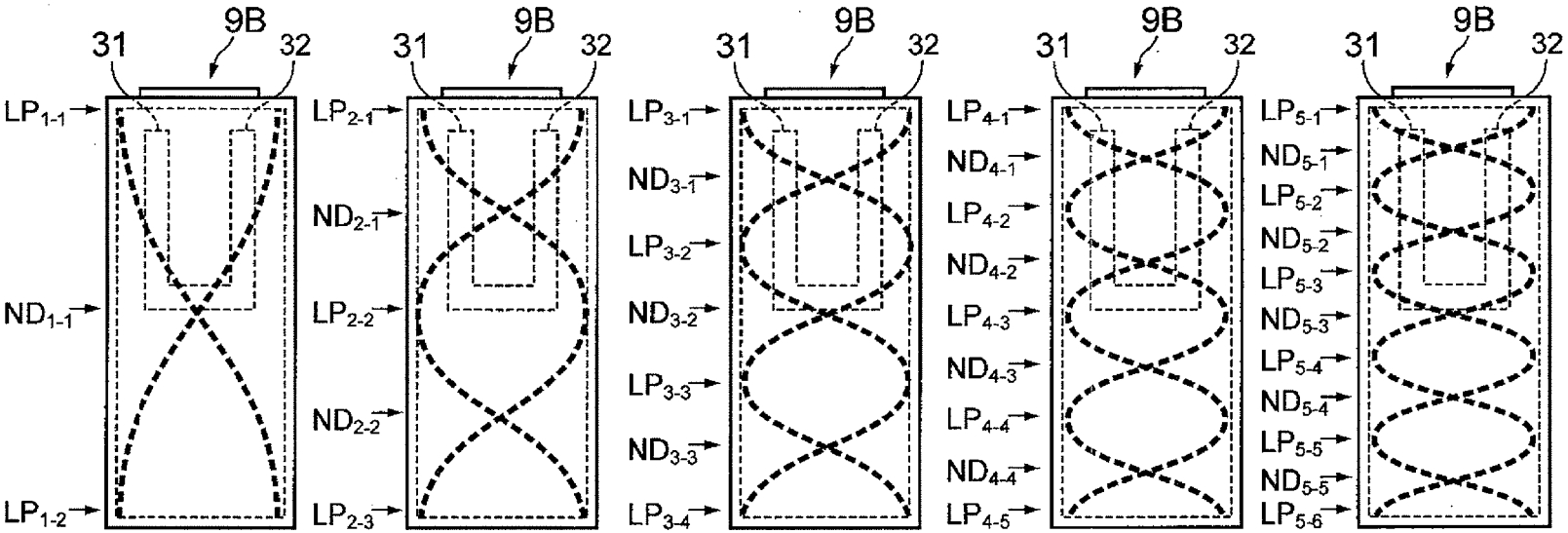
FIGS. 13A to 13E are diagrams, each illustrating a position relationship between a stationary wave and an open end of an open pipe in the speaker.

The inventors carried out the following verification in order to confirm the effect of this embodiment. For the speaker 9B which is the example illustrated in FIG. 11A, by inputting a test sound signal ST to the speaker unit 2 and measuring the sound wave irradiated from the speaker unit 2 at a measuring point P in the space S (more specifically, a measuring point P in the inner vicinity of the position in which the wall surfaces 4D, 4B and 4R are intersected) (see FIG. 11A), the inventors calculated a frequency response R-9B which is a spectrum difference between the input signal ST and a measured signal SM by means of simulation. Similarly, for a speaker 9B' in which the open pipe 30 is removed from the speaker 9B, by inputting a test sound signal ST to the speaker unit 2 and measuring the sound wave irradiated from the speaker unit 2 at the measuring point P, the inventors calculated a frequency response R-9B' which is a spectrum difference between the input signal ST and a measured signal SM by means of simulation. FIG. 12 illustrates the frequency responses R-9B and R-9B' at the same frequency axis.

Referring to FIG. 12, a peak appears in the proximity of 160 Hz, 320 Hz, 480 Hz, 650 Hz, 820 Hz, and 970 Hz in any frequency responses R-9B and R-9B'. For the frequency response R-9B, amplitude of the peak in the proximity of 320 Hz, 650 Hz and 970 Hz is substantially equal to that in the frequency response R-9B', but amplitude of the peaks in the proximity of 160 Hz, 480 Hz and 820 Hz is smaller than that in the frequency response R-9B'. Also, for the frequency response R-9B, the peaks in the proximity of 160 Hz, 480 Hz and 820 Hz are split. It is confirmed from this fact that the first-order stationary wave $SW_1$ (160 Hz), the third-order stationary wave $SW_3$ (480 Hz) and the fifth-order stationary wave $SW_5$ (820 Hz) are suppressed in the space S by the speaker 9B.

The invertors made an assumption about that suppression of the stationary waves $SW_1$, $SW_3$ and $SW_5$ in the space S of the speaker 9B is caused by the following reason on the basis of the verified result of the verification. As illustrated in FIGS. 13A to 13E, two open ends 31 and 32 of the open pipe 30 in the space S are disposed at the position of the loop $LP_{1-1}$ of the stationary wave $SW_1$ in the speaker 9. The position of the loop $LP_{1-1}$ of the stationary wave $SW_1$ corresponds to the loops $LP_{2-1}$, $LP_{3-1}$, $LP_{4-1}$ and $LP_{5-1}$, . . . of the second-order and subsequent stationary waves $SW_2$, $SW_3$, $SW_4$ and $SW_5$, . . . . Accordingly, in the case where the stationary wave $SW_k$ (k=1, 2, . . . ) is generated in the space S, a medium (air) in the vicinity of the open ends 31 and 32 of the open pipe 30 is vibrated by variation in sound pressure at the position of the loop LP of each stationary wave $SW_k$.

Figure 14A:
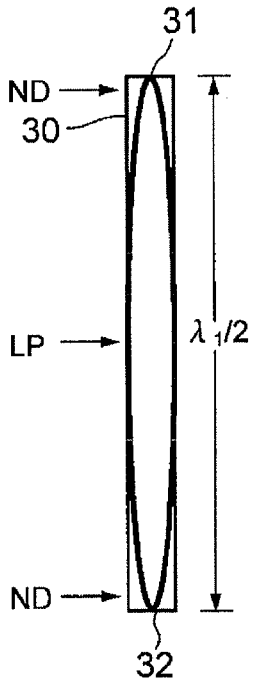
FIGS. 14A and 14B are diagrams, each illustrating a waveform of a resonance wave in the open pipe of the speaker.

In view of the relationship between the first-order stationary wave $SW_1$ in the space S and the behavior of the medium (air) in the open pipe 30, the medium (air) in the vicinity of the open ends 31 and 32 of the open pipe 30 is vibrated by variation in sound pressure of the loop $LP_{1-1}$ of the stationary wave $SW_1$, and traveling waves $TW_1$ and $TW_1'$ having the same phase and traveling in an opposite direction are generated. The reason why the traveling waves $TW_1$ and $TW_1'$ have the same phase is that a source of generating the traveling waves $TW_1$ and $TW_1'$ is identical. If the traveling waves $TW_1$ and $TW_1'$ are composed in the open pipe 30, a resonance wave $XW_1$ having the same wavelength $\lambda_1$ as that of the stationary wave $SW_1$ is generated. The resonance wave $XW_1$ is generated by composing the traveling wave $TW_1$ and $TW_1'$, as illustrated in FIG. 14A, so that the resonance wave $XW_1$ at the middle of the open ends 31 and 32 becomes the loop LP. Since the pipe length of the open pipe 30 is equal to a length $\lambda_1/2$ corresponding to the half wavelength of the stationary wave $XW_1$, the center of the open ends 31 and 32 becomes the loop LP, and thus the sides of the open ends 31 and 32 become the node ND. For this reason, distribution in sound pressure of the stationary wave $SW_1$ at the positions of the open ends 31 and 32 is alleviated. The inventors made an assumption about that alleviation of the stationary wave $SW_1$ is caused by the above reason. Also, resonance waves $XW_3$, $XW_5$, $XW_7$, . . . generated when the medium (air) in the vicinity of the open ends 31 and 32 of the open pipe 30 is vibrated become the node ND at the sides of the open ends 31 and 32. Therefore, the inventors made an assumption about that the odd-order stationary waves $SW_3$, $SW_5$, $SW_7$, . . . of three-order or subsequent are alleviated by the same reason.

Figure 14B:
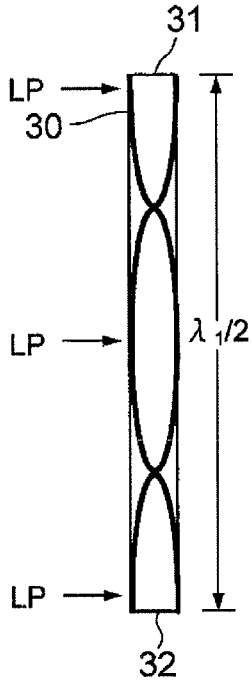

Next, in view of the relationship between the second-order stationary wave $SW_2$ in the space S and the behavior of the medium (air) in the open pipe 30, the medium (air) in the vicinity of the open ends 31 and 32 is vibrated by variation in sound pressure of the loop $LP_{2-1}$ of the stationary wave $SW_2$, and traveling waves $TW_2$ and $TW_2''$ traveling in an opposite direction and having the same phase is generated. If the traveling waves $TW_2$ and $TW_2''$ are composed in the open pipe 30, a resonance wave $XW_2$ having the same wavelength $\lambda_2$ as that of the stationary wave $SW_2$ is generated. As illustrated in FIG. 14B, the resonance wave $XW_2$ becomes the loop LP at a middle of the open ends 31 and 32. Since a pipe length of the open pipe 30 is equal to the wavelength $\lambda_2$ of the stationary wave $SW_2$, if the middle of the open ends 31 and 32 becomes the loop LP, the sides of the open ends 11 and 12 also become the loop LP. For this reason, distribution in sound pressure of the stationary wave $SW_2$ at the positions of the open ends 31 and 32 is not alleviated. The inventors made an assumption about that the stationary wave $SW_2$ is not alleviated by the above reason. Also, the resonance waves $XW_4$, $XW_6$, $XW_8$, . . . generated when the medium (air) in the vicinity of the open ends 31 and 32 of the open pipe 30 is vibrated become the loop LP at the sides of the open ends 31 and 32. Therefore, the inventors made an assumption about that the even-order stationary waves $SW_4$, $SW_6$, $SW_8$, . . . of fourth-order or subsequent are not alleviated by the same reason.

Third Embodiment

Figure 15:
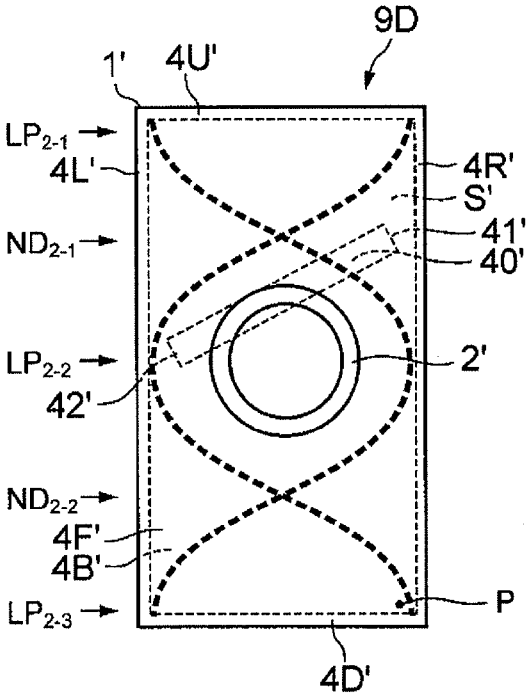
FIG. 15 is a front view of a speaker according to a third embodiment of the present invention.

FIG. 15 is a front view of a speaker 9D according to a third embodiment of the present invention. The speaker 9D includes a cabinet 1', a speaker unit 2' fixed to an outside of the cabinet 1', and an open pipe 40' accommodated in a space S' of the cabinet 1'. The cabinet 1' is formed in a hollow rectangular cubic shape enclosed by wall surfaces 4U' and 4D' opposite to each other in upward and downward directions, wall surfaces 4F' and 4B' opposite to each other in back and forth directions, and wall surfaces 4L' and 4R' opposite to each other in right and left directions. A width W' (distance between the wall surfaces 4L' and 4R'; for example, W'=430 mm) is set to be larger than a depth L' (distance between the wall surfaces 4F' and 4B'; for example, L'=200 mm). In addition, a height H (distance between the wall surfaces 4U' and 4D'; for example, H'=1050 mm) in the space S is set to be larger than the width W'.

The speaker unit 2' of the speaker 9D is fixed to a substantially center (placed at the node $ND_{1-1}$ of the first-order stationary wave $SW_4$ which is generated in the space S'). The open pipe 40' of the speaker 9D is formed in a straight shape having a pipe length of the half wavelength of the second-order stationary wave $SW_2$ which is generated in the space S'. The open pipe 40' is fixed on the wall surface 4F' in the space S' in a posture which inclines with respect to the opposite direction of two opposite surfaces of the wall surfaces 4U' and 4D'. The open end 41' of the open pipe 40' is disposed at the position of a substantial node $ND_{2-1}$ of the stationary wave $SW_2$, and the open end 42' is disposed at the position of a substantial loop $LP_{2-2}$ of the stationary wave $SW_2$. With the speaker 9D, it is possible to suppress the stationary wave $SW_k$ which is generated in the opposite direction of the wall surfaces 4U' and 4D'. Also, since the open pipe 40' is formed in the straight shape in the speaker 9D, it is possible to conveniently manufacture or machine the open pipe 40', as compared to the case of the speakers 9 to 9C.

Figure 16:
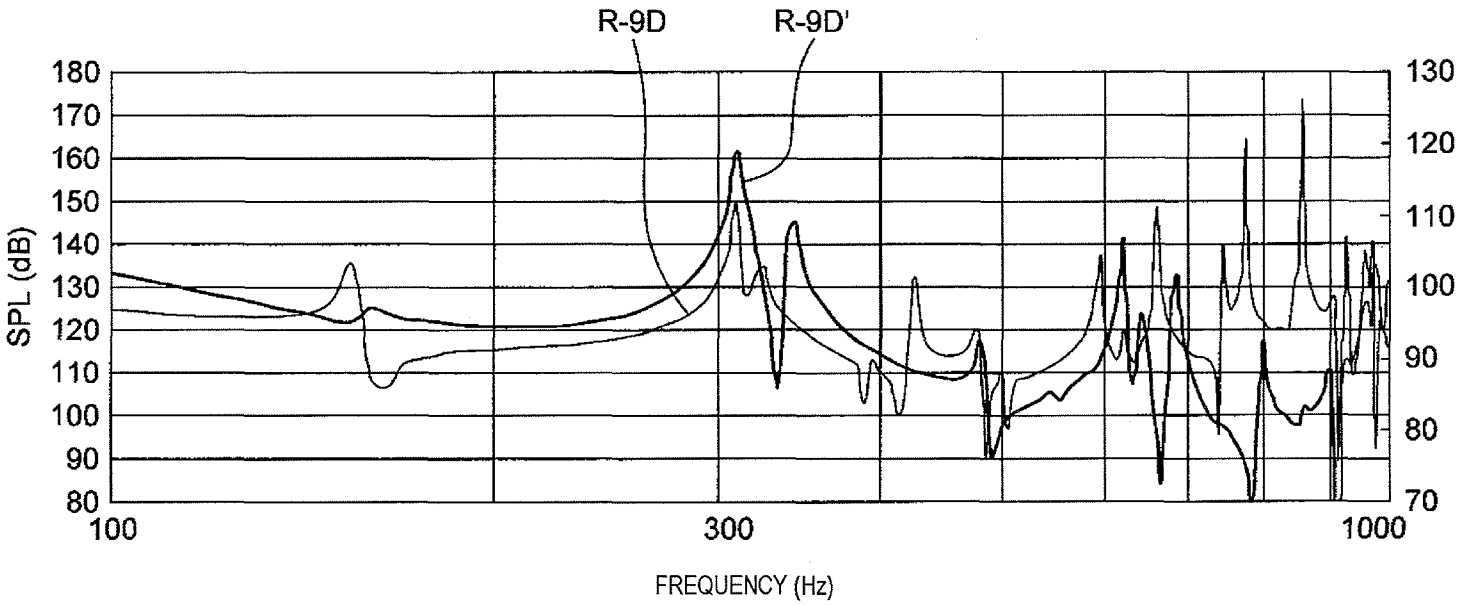
FIG. 16 is a graph illustrating a frequency response which is a verification result of the speaker.

The inventors carried out the following verification in order to confirm the effect of the third embodiment. For the speaker 9D illustrated in FIG. 15, by inputting a test sound signal ST to the speaker unit 2' and measuring the sound wave irradiated from the speaker unit 2' at a measuring point P in the space S (more specifically, a measuring point P in the inner vicinity of the position in which the wall surfaces 4D', 4B' and 4R' are intersected) (see FIG. 15), the inventors calculated a frequency response R-9D which is a spectrum difference between the input signal ST and a measured signal SM by means of simulation. Similarly, for a speaker 9D' in which the open pipe 40' is removed from the speaker 9D, by inputting a test sound signal ST to the speaker unit 2 and measuring the sound wave irradiated from the speaker unit 2' at the measuring point P, the inventors calculated a frequency response R-9D' which is a spectrum difference between the input signal ST and a measured signal SM by means of simulation. FIG. 16 illustrates the frequency responses R-9D and R-9D' at the same frequency axis.

Referring to FIG. 16, a peak appears in the proximity of 300 Hz in any frequency responses R-9D and R-9D'. For the frequency response R-9D, amplitude of the peak in the proximity of 300 Hz is smaller than that in the frequency response R-9D'. Also, for the frequency response R-9D, the peak in the proximity of 300 Hz is split. It is confirmed from this fact that the second-order stationary wave $SW_2$ is suppressed in the space S' by the speaker 9D'.

Fourth Embodiment

Figure 17:
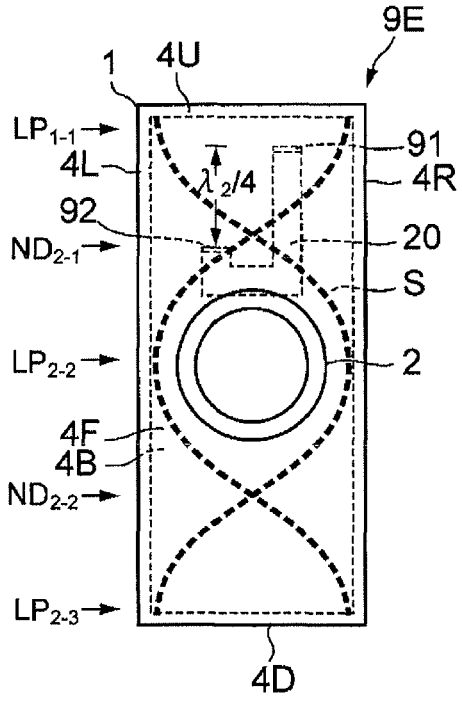
FIG. 17 is a front view of a speaker according to a fourth embodiment of the present invention.

FIG. 17 is a front view of a speaker 9E according to a fourth embodiment of the present invention. The speaker 9E is a modified speaker in which both open ends of the open pipe 20 are covered with an air-permeable sound absorbing material (e.g., non-woven textile fabric). Also, both open ends 91, 92 of the open pipe 20 are wholly covered with the air-permeable sound absorbing material in the example of FIG. 17, but only a portion of the open ends 91 and/or 92 may be covered with the air-permeable sound absorbing material. As known in the art, the air-permeable sound absorbing material has a property of blunting the peak or deep in the frequency response in the space which is spaced apart from the exterior. According to the fourth embodiment, it is possible to make a suppression amount of the second stationary wave $SW_2$ larger than the first embodiment.

Figure 18:
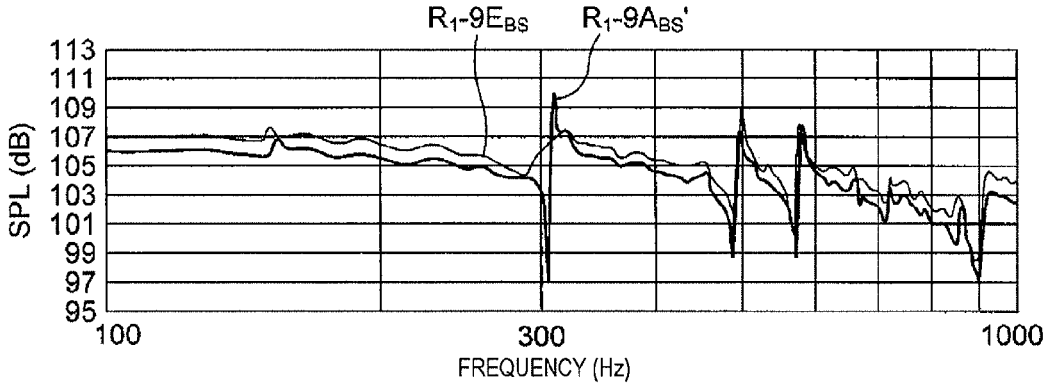
FIG. 18 is a graph illustrating a frequency response which is a verification result of the speaker.
Figure 19:
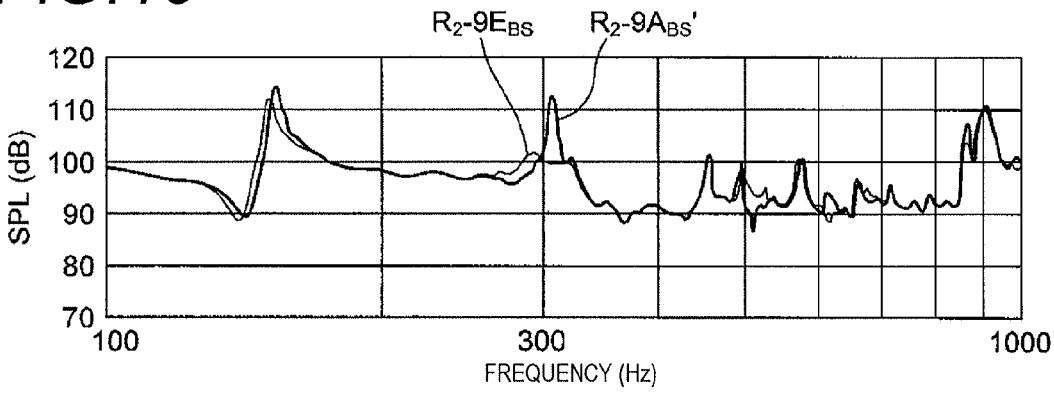
FIG. 19 is a graph illustrating a frequency response which is a verification result of the speaker.
Figure 20:
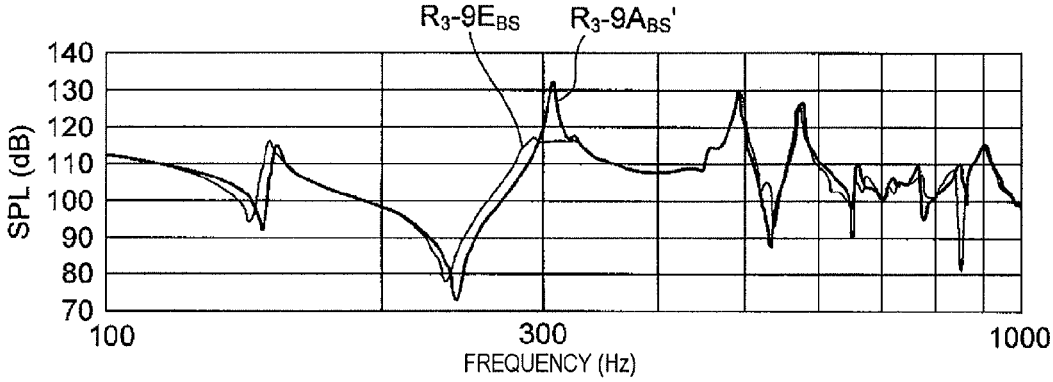
FIG. 20 is a graph illustrating a frequency response which is a verification result of the speaker.

The inventors carried out the following verification in order to confirm the effect of the second embodiment. The inventors employed the speaker $9E_{BS}$ in which both open ends of the open pipe OP in the speaker $9A_{BS}$ used for the verification of the first embodiment are covered with the air-permeable sound absorbing material. Also, for the speaker $9E_{BS}$, the inventors calculated frequency responses $R_1$-$9E_{BS}$, $R_2$-$9E_{BS}$ and $R_3$-$9E_{BS}$ which are a spectrum difference between the input signal ST of the speaker unit $SU_{CNT}$ and a measured signal SM at the measured points P-1, P-2 and P-3. FIG. 18 illustrates the frequency response $R_1$-$9E_{BS}$ and the frequency response $R_1$-$9A_{BS}'$ (FIG. 8) used for the verification of the first embodiment at the same frequency axis. FIG. 19 illustrates the frequency response $R_2$-$9E_{BS}$ and the frequency response $R_2$-$9A_{BS}'$ (FIG. 9) used for the verification of the first embodiment at the same frequency axis. FIG. 20 illustrates the frequency response $R_3$-$9E_{BS}$ and the frequency response $R_3$-$9A_{BS}'$ (FIG. 10) used for the verification of the first embodiment at the same frequency axis.

Referring to FIGS. 18, 19 and 20, for the frequency responses $R_1$-$9E_{BS}'$, $R_2$-$9E_{BS}'$ and $R_3$-$9E_{BS}'$, a steep peak is generated in the proximity of 300 Hz, but for the frequency responses $R_1$-$9E_{BS}$, $R_2$-$9E_{BS}$ and $R_3$-$9E_{BS}$, amplitude in the proximity of 300 Hz is substantially flat. For the speaker $9E_{BS}$, it is confirmed from this fact that a suppression amount of the second-order stationary wave $SW_2$ is increased as compared to the bass reflex speaker $9A_{BS}$ illustrated in FIG. 7.

Although the embodiments of the present invention have been explained hereinbefore, various embodiments can be devised in the present invention as follows.

Figure 21:
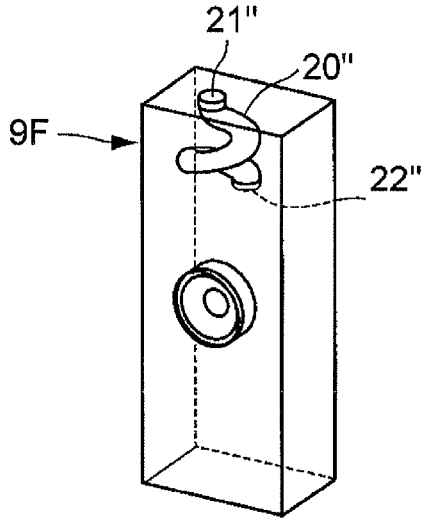
FIG. 21 is a perspective view of a speaker according to another example of the present invention.

(1) The open pipes 10 and 20 in the space S of the speakers 9 and 9A according to the first embodiment may be replaced by others having a shape different from the J-shape. For example, like the speaker 9F illustrated in FIG. 21, the open pipe 20 of the speaker 9A which is the example of FIG. 2 may be replaced by an open pipe 20" formed in a spiral shape. In this instance, it is desirable (but non limited) that an open end 21" of the open pipe 20" is disposed at the position of the substantial loop LP of the stationary wave $SW_2$ in the space S, and an open end 22" is disposed at the position of the substantial node ND of the stationary wave $SW_2$. With the configuration, the same effect as that of the first embodiment can be achieved. Also, the open pipe 10 or the open pipe 20 may be formed in a zigzag shape (e.g., W-shape, N-shape, Z-shape, or S-shape). Also, in the speakers 9, 9A, 9B 9C and 9E, a portion of the bent portion of the respective open ends 10, 20, 30 and 40 in the cabinet 1 may be formed to protrude outward from the cabinet 1, and the portion of the open portions 10, 20, 30 and 40 which protrudes outward from the cabinet 1 may be utilized as a handle for holding the speakers 9, 9A, 9B, 9C and 9E.

(2) The first to fourth embodiments apply the present invention to suppress the stationary wave $SW_k$ of the space in the cabinets of the speakers 9, 9A, 9B, 9C and 9E. The present invention can be applied, however, to suppress the stationary waves such as a different kind of audio apparatus including a housing (audio chamber) including a space enclosed by at least a pair of opposite surfaces, a transport plane, housing or the like. For example, the present invention can be applied to suppress the stationary wave of the space in the housing of an audio piano, an electronic piano, or a guitar. In addition, the present invention can be applied to suppress the stationary wave of the space in the housing of a vehicle, a train, an airplane, a motorcycle, a wet bike, a ship, or a rocket. Furthermore, the present invention can be applied to suppress the stationary wave of the space enclosed by walls such as a soundproof room, a classroom, or a performance room.

(3) In the third embodiment, the open pipe 40' is fixed on the wall surface 4F' in the space S' in a posture which inclines with respect to the opposite direction of two opposite surfaces of the wall surfaces 4U' and 4D'. However, the open pipe 40' may be fixed on the wall surface 4B' in the space S' in a posture which inclines with respect to the opposite direction of two opposite surfaces of the wall surfaces 4U' and 4D'. Also, the open pipe 40' may be accommodated in the space S' in a posture which inclines with respect to the opposite direction of two opposite surfaces of the wall surfaces 4U' and 4D', and is not necessarily fixed to the wall surface 4F' or the wall surface 4B'. For example, the open end 41' of the open pipe 40' may be disposed near the intersected position of the wall surfaces 4F' and 4L', and the open end 42' may be disposed near the intersected position of the wall surfaces 4B' and 4R'. By contrast, the open end 42' of the open pipe 40' may be disposed near the intersected position of the wall surfaces 4F' and 4L', and the open end 41' may be disposed near the intersected position of the wall surfaces 4B' and 4R'.

(4) In the third embodiment, the open pipe 40' is formed in the straight shape. However, the open pipe 40' may be bent in a J-shape, a U-shape or other shapes.

(5) In the fourth embodiment, both open ends of the open pipe 20 in the speaker 9A are covered with the air-permeable sound absorbing material. However, one open end of the open pipe 20 may be covered with the air-permeable sound absorbing material. Also, one or both open ends of the open pipe 10 of the speaker 9 illustrated in FIGS. 1A and 1B may be covered with the air-permeable sound absorbing material. Furthermore, one or both open ends of the open pipe 30 of the speaker 9B illustrated in FIGS. 11A and 11B may be covered with the air-permeable sound absorbing material. In addition, one or both open ends of the open pipe 40' of the speaker 9D illustrated in FIG. 15 may be covered with the air-permeable sound absorbing material.

(6) In the fourth embodiment, both open ends 91, 92 of the open pipe 20 are covered with the non-woven textile fabric which is one of the air-permeable sound absorbing material. However, a porous material of interconnected cells, such as urethane foam or foamed resin, or a member having a construction regarded as a porous material, such as glass wool, aluminum foaming metal, metallic fiberboard, wood chip or its debris, wood fiber, pulp fiber, MPP (microperforated panel), cow fur felt, recovered wool felt, wool, cotton, non-woven fabric, cloth, synthetic fiber, wood powder molding material, or paper molding material may be used as the non-woven textile fabric.

(7) In the first embodiment to the fourth embodiment, the open pipes 10 and 30 have the pipe length of a substantially half wavelength of the first-order stationary wave $SW_1$. However, in the case where first-order stationary wave $SW_1$ is not necessarily suppressed, the pipe length of the open pipes 10 and 30 may be a substantially half wavelength of the second-order or subsequent stationary wave $SW_k$. Similarly, the pipe length of the open pipes 20 and 40' may be a substantially half wavelength of the third-order or subsequent stationary wave $SW_k$. Further, although the open pipes 10 and 30 in the first embodiment to the fourth embodiment have the pipe length of a substantially half wavelength of the first-order stationary wave $SW_1$, the pipe length may be a length of integral multiple of a substantially half wavelength of kth (k=1, 2, . . . ) stationary wave $SW_k$.

(8) In the first, second and fourth embodiments, plural kinds of open pipes 10, 20 and 30 having different pipe length may be accommodated in the space S in the cabinet 1. Also, in the third embodiment, plural kinds of open pipes 40' having different pipe length may be accommodated in the space S' in the cabinet 1'. In addition, in the third embodiment, in order to suppress plural kinds of stationary waves $SW_k$ among the stationary waves $SW_k$ which are generated in the opposite direction of the wall surface 4U' and 4D', the opposite direction of the wall surface 4F' and 4B', and the opposite direction of the wall surface 4L' and 4R', plural kinds of open pipes 40' having different slope direction may be accommodated in the space S' in the cabinet 1'.

(9) In the first, second and fourth embodiments, the stationary wave $SW_k$ in the direction of the wall surfaces 4U and 4D in the space S in the cabinet 1 is a target to be suppressed. However, the stationary wave $SW_k$ in the direction of the wall surfaces 4F and 4B or the stationary wave $SW_k$ in the direction of the wall surfaces 4L and 4R may be a target to be suppressed, and the open pipes for suppressing the stationary waves may be replaced by the open pipes 10, 20 and 30, or may be accommodated in the space S together with the open pipes 10, 20 and 30.

(10) The present invention focuses on reducing a stationary wave which is generated in a space enclosed by at least a pair of opposed surfaces of a housing and providing in the housing an open pipe that generates another stationary wave which cannot coexist with the stationary wave. FIGS. 22A to 22F are diagrams, each illustrating schematically and exhaustively a relationship between a stationary wave generated in a space of the cabinet and an open pipe in the audio apparatus. Those diagrams show an open pipe L2 provided in a housing of the audio apparatus, a first open end N1 and a second open end N2 of the open pipe L2, and a length L1 extended between the first open end N1 and the second open end N2 in an opposite direction of the pair of opposed surfaces of the housing.

Figure 22A:
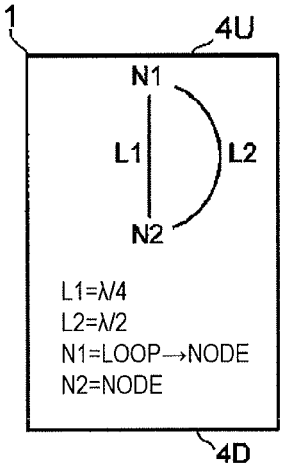
FIGS. 22A to 22F are diagrams, each illustrating schematically and exhaustively a relationship between a stationary wave generated in a space of the cabinet and an open pipe in an audio apparatus.
Figure 22B:
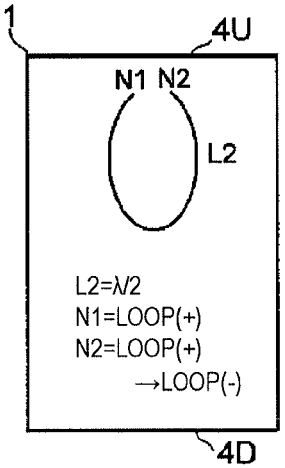
Figure 22C:
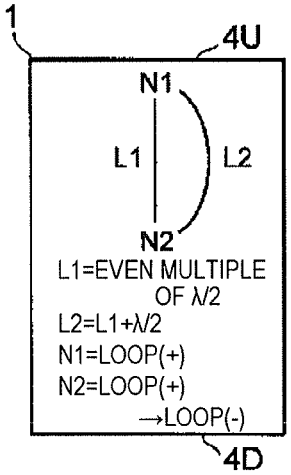
Figure 22D:
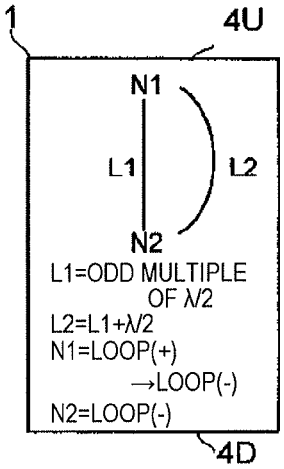

An example shown in FIG. 22A is an aspect described in the first embodiment (FIG. 1A). An example shown in FIG. 22B is an aspect described in the third embodiment (FIG. 11A). Aspects of FIG. 22C and FIG. 22D are also considered as modified examples of the aspect shown in FIG. 22B. In those aspects, since the open pipe generates another stationary wave which cannot coexist with the stationary wave generated between the wall surfaces 4U and 4D, the stationary wave generated between the wall surfaces 4U and 4D can be reduced.

Figure 22E:
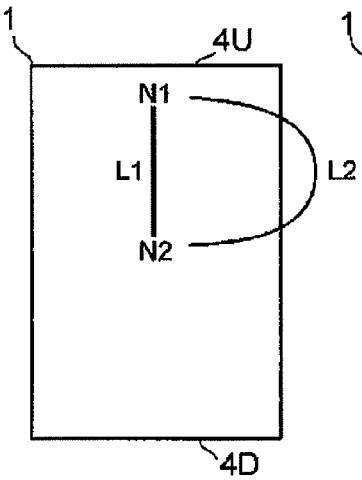
Figure 22F:
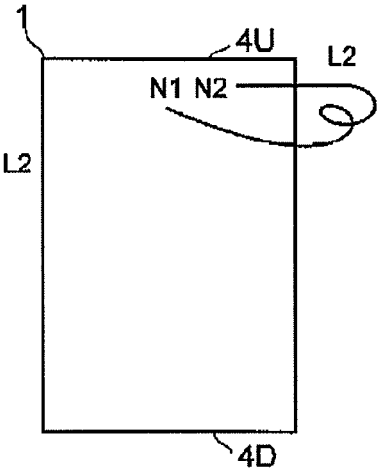

In these cases, the shape and form of the open pipe are arbitrary. The open pipe may be led out outside the cabinet 1 as shown in FIG. 22E. In addition, the open pipe may be led out outside the cabinet 1 and have a spiral shape as shown in FIG. 22F.

What is claimed is:

1. An audio apparatus, comprising:

a housing including a space which is enclosed at least one pair of opposite surfaces; and an open pipe including a first open end and a second open end positioned in the space, wherein the open pipe has a pipe length of integral multiple of a substantially half wavelength of a stationary wave which is generated in the space, and the first open end of the open pipe is disposed at a position of a substantial loop of the stationary wave which is generated in the space.

2. The audio apparatus according to claim 1, wherein the second open end of the open pipe is disposed at a position of a substantial node of the stationary wave which is generated in the space.

3. The audio apparatus according to claim 1, wherein the first and second open ends of the open pipe are respectively disposed at positions which are spaced apart from each other by a length of odd multiple of a substantially quarter wavelength of the stationary wave along an opposite direction of the one pair of opposite surfaces.

4. The audio apparatus according to claim 1, wherein the second open end of the open pipe is disposed at a position of a substantial loop of the stationary wave which is generated in the space.

5. The audio apparatus according to claim 1, wherein at least one of the first and second open ends of the open pipe is wholly or partially covered with an air-permeable sound absorbing material.

6. An audio apparatus comprising:

a housing including a space which is enclosed at least one pair of opposite surfaces; and a curved open pipe including a first open end and a second open end positioned in the space, wherein the open pipe has a pipe length of integral multiple of a substantially half wavelength of a stationary wave which is generated in the space.

7. The audio apparatus according to claim 6, wherein the first open end and the second open end of the open pipe are open in a same direction.

* * * * *